US007368686B2

(12) United States Patent
Etheredge et al.

(10) Patent No.: US 7,368,686 B2
(45) Date of Patent: May 6, 2008

(54) APPARATUS AND METHODS FOR OPERATING AN ELECTRIC APPLIANCE

(75) Inventors: John L. Etheredge, Ooltewah, TN (US); Philip A. Barber, Louisville, KY (US); Brian Henninger, LaGrange, KY (US); Timothy Scott Shaffer, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/516,339

(22) Filed: Sep. 6, 2006

(65) Prior Publication Data

US 2008/0083729 A1 Apr. 10, 2008

(51) Int. Cl.
*A21B 1/22* (2006.01)
*H02J 3/14* (2006.01)

(52) U.S. Cl. ..... 219/412; 219/485; 219/486; 219/487; 219/508; 219/394; 219/398; 219/480; 219/446.1; 219/445.1; 219/457.1; 219/462.1; 219/414; 307/38; 307/39; 307/35; 307/41

(58) Field of Classification Search ..... 219/412, 219/485–7, 508, 394, 398, 446.1, 480, 445.1, 219/457.1, 462.1, 414; 307/39, 41, 35, 38
See application file for complete search history.

(56) References Cited

U.S. PATENT DOCUMENTS 4,695,738 A 9/1987 Wilmot
6,157,008 A * 12/2000 Brown et al. ..... 219/486
6,700,101 B2 3/2004 Decesari et al.

* cited by examiner

*Primary Examiner*—Shawntina Fuqua
(74) *Attorney, Agent, or Firm*—George L. Rideout, Esq.; Armstrong Teasdale LLP

(57) ABSTRACT

An electric cooking appliance is provided. The electric cooking appliance includes a plurality of surface heating elements and a plurality of sensors configured to monitor an operational status of a corresponding surface heating element. The electric cooking appliance also includes a first cooking unit, a second cooking unit and an electronic control to facilitate sharing power between the first cooking unit and the second cooking unit based on the operational status of the plurality of surface heating elements.

20 Claims, 5 Drawing Sheets

APPARATUS AND METHODS FOR OPERATING AN ELECTRIC APPLIANCE

BACKGROUND OF THE INVENTION

This invention relates generally to electric appliances and, more particularly, to apparatus and methods for facilitating power sharing within an electric appliance.

At least some known appliances incorporate numerous electrical devices that may be operated simultaneously. For example, at least some known ranges include at least four surface heating elements and dual ovens. Typically, ranges have a limited available power supply due to building codes and preset limits within the electrical wiring of the building. As a result, use of a range may be limited by the available power supply.

Some known household ranges control distribution of the power available to the various devices within the range. For example, some known dual ranges incorporate feedback loops and controls that facilitate operating the ranges at a lower power when both ranges are in use. As such, the available power within the range is distributed such that both ranges may remain operational. Such known ranges utilize feedback loops from the ovens and distribute power as though all of the surface heating elements are in use. Therefore, power is limited any time both ovens are simultaneously utilized. However, the use of both ovens does not always warrant power distribution, for example, when none of the surface heating elements are being utilized. As such, known household ranges often unnecessarily limit power to the ovens and/or limit power to or prevent use of the surface heating elements when both ovens are simultaneously utilized.

BRIEF DESCRIPTION OF THE INVENTION

In one aspect, an electric cooking appliance is provided. The electric cooking appliance includes a plurality of surface heating elements and a plurality of sensors configured to monitor an operational status of a corresponding surface heating element. The electric cooking appliance also includes a first cooking unit, a second cooking unit and an electronic control to facilitate sharing power between the first cooking unit and the second cooking unit based on the operational status of the plurality of surface heating elements.

In another aspect, an electronic system configured for facilitating power sharing is provided. The electronic system includes a plurality of power consuming elements and a plurality of first sensors each operatively coupled to a corresponding power consuming element of the plurality of power consuming elements. Each first sensor monitors an operational status of the corresponding power consuming element. The electronic system also includes a first unit including a first operation element, a second operation element and a third operation element and a second unit including a fourth operation element, a fifth operation element and a sixth operation element. A control unit is operatively coupled to the first unit and the second unit. The control unit shares power between the first unit and the second unit based on the operational status of the plurality of power consuming elements.

In another aspect, a method of operating an electric cooking appliance is provided. The method includes monitoring an operational status of a plurality of surface heating elements using a sensor and sharing power between a first cooking unit and a second cooking unit based on the operational status of the plurality of surface heating elements.

DETAILED DESCRIPTION OF THE INVENTION

The present invention provides a method and apparatus for operating an electric appliance, such as a range, wherein power is shared between a first oven and a second oven by operating at least one of the two ovens in a reduced power mode. By utilizing a reduced power mode, the range is able to operate within a building's limited power supply. In one embodiment, the range shares power by operating only one available heating element within at least one of the two ovens. In an alternative embodiment, the range shares power by limiting a number of heating coils utilized by the heating elements.

The present invention is described below in reference to its application in connection with and operation of an electric cooking range. However, it will be apparent to those skilled in the art and guided by the teachings herein provided that the invention is likewise applicable to any electric appliance suitable for power sharing.

Figure 1:
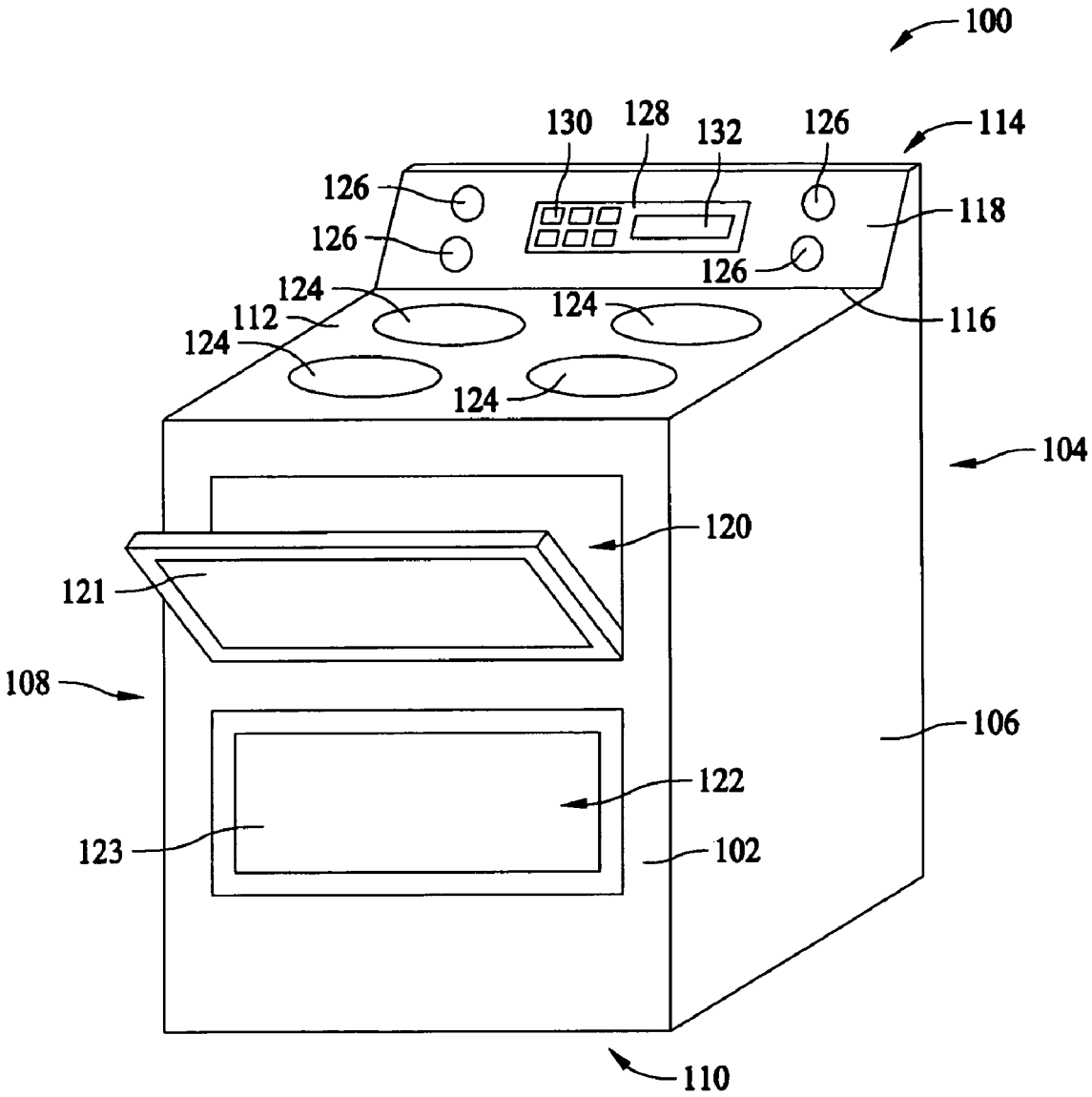
FIG. 1 is a perspective view of an exemplary household range.

FIG. 1 is a perspective view of an exemplary household range 100. In the exemplary embodiment, range 100 includes a front surface 102, a back surface 104, a first side 106 extending between front surface 102 and back surface 104 and a second side 108 extending between front surface 102 and back surface 104. Range 100 also includes a bottom portion 110 and a top surface 112 that both extend between front surface 102 and back surface 104 and between sides 106 and 108. Further, range 100 includes a control center 114 coupled to a back edge 116 of top surface 112 and having a control surface 118. In alternative embodiments, control center 114 is positioned at a different location within range 100.

In the exemplary embodiment, front surface 102 includes an upper oven 120 including a hingedly attached door 121. In the exemplary embodiment, door 121 is shown in an open configuration. The exemplary embodiment also includes a lower oven 122 including a hingedly attached door 123. In the exemplary, door 123 is shown in a closed configuration. Alternatively, range 100 includes any suitable number of ovens in any arrangement or location. Further, in the exemplary embodiment, range 100 includes a plurality of surface heating elements 124, such as four surface heating elements 124, defined within or mounted with respect to top surface 112. Moreover, in an alternative embodiment, range 100 includes any suitable number of surface heating elements 124.

Control center 114 includes four surface heating element controls 126 and an electronic control 128. In an alternative embodiment having more or less than four surface heating elements 124, the number of surface heating element controls 126 corresponds to the number of surface heating elements 124. In the exemplary embodiment, surface heating element controls 126 are dials. In alternative embodiments, surface heating element controls 126 are electronic buttons or switches. Surface heating element controls 126 are electrically coupled to surface heating elements 124, such that each surface heating element 124 is activated and/or controlled by a corresponding surface heating element control 126. Surface heating element controls 126 are electrically coupled to electronic control 128.

In one embodiment, electronic control 128 includes six electronic buttons 130 and a display 132. Electronic buttons 130 facilitate user input to select a function for upper oven 120 and/or lower oven 122. Electronic control 128 is electrically coupled to upper oven 120 and lower oven 122 such that electronic control 128 activates and/or controls upper oven 120 and lower oven 122 based upon the user input with electronic buttons 130. In alternative embodiments, control center 114 may include any number of electronic buttons 130 for facilitating operating upper oven 120 and/or lower oven 122. Display 132 displays information related to the operation of upper oven 120, lower oven 122 and/or surface heating elements 124. Moreover, electronic control 128 facilitates power sharing between upper oven 120, lower oven 122 and/or surface heating elements 124.

Figure 2:
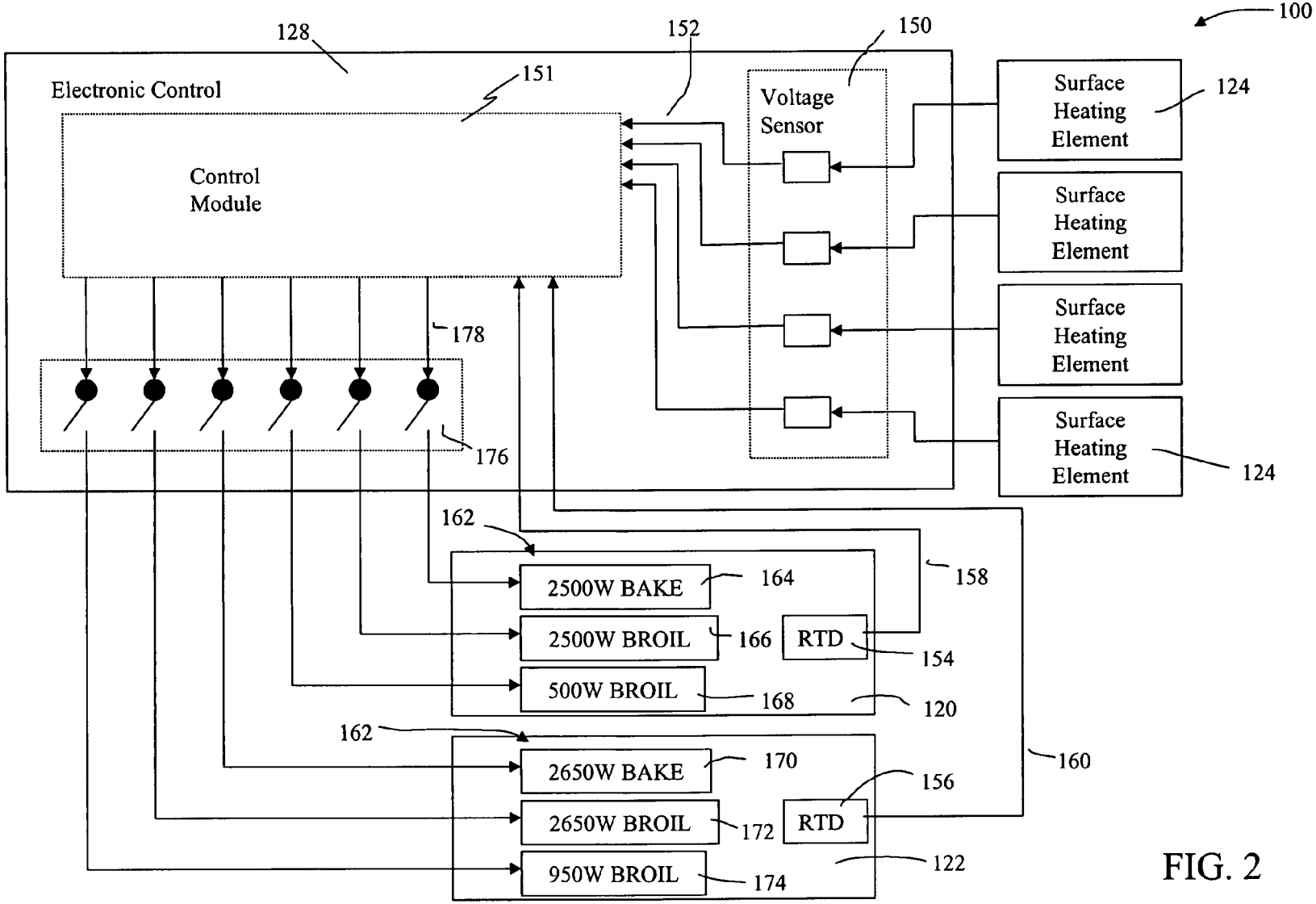
FIG. 2 is a power sharing electrical configuration suitable for use with the range shown in FIG. 1.

FIG. 2 is an electronic schematic of range 100. Electronic control 128 is electrically coupled to surface heating elements 124, upper oven 120 and lower oven 122. A voltage sensor 150 is electrically coupled between a control module 151 and each corresponding surface heating element 124. Each voltage sensor 150 determines which corresponding surface heating element 124 is activated and transmits a signal through a signal path 152 to control module 151 indicative of an operational status of corresponding surface heating element 124. Further, a resistance temperature detector 154 is electrically coupled between upper oven 120 and electronic control 128, and a resistance temperature detector 156 is electrically coupled between lower oven 122 and electronic control 128. Resistance temperature detectors 154 and 156 transmit a signal through signal paths 158 and 160, respectively, to the electronic control 128 to determine whether preheat is required in either of upper oven 120 and lower oven 122.

A plurality of heating elements 162 are positioned within upper oven 120 and electrically coupled to a power supply. In one embodiment, a 2500 W bake element 164, a 2500 W broil element 166 and a 500 W broil element 168 are coupled within upper oven 120 and electrically coupled to the power supply. Similarly, a plurality of heating elements 162 are positioned within lower oven 122 and electrically coupled to the power supply. In one embodiment, a 2650 W bake element 170, 2650 W broil element 172 and a 950 W broil element 174 are positioned within lower oven 122 and electrically coupled to the power supply. In alternative embodiments, heating elements 162 operate at different wattages.

Each signal transmitted by voltage sensor 150 and/or resistance temperature detectors 154 and 156 is transmitted to control module 151, which assesses the operational status of surface heating elements 124, upper oven 120 and/or lower oven 122. Based upon the operational status of the range elements, electronic control 128 shares power between upper oven 120 and lower oven 122. In one embodiment, control module 151 sends a signal through signal path 178 and activates one or more switches 176 to provide electrical communication between electronic control 128 and one or more of heating elements 162. In a particular embodiment, during normal range operations upper oven 120 utilizes a combination, such as two, of 2500 W bake element 164, 2500 W broil element 166 and 500 W broil element 168. Similarly, lower oven 122 utilizes a combination, such as two, of 2650 W bake element 170, 2650 W broil element 172 and 950 W broil element 174. Specifically, in this particular embodiment, in a preheat configuration, upper oven 120 utilizes 2500 W bake element 164 and 500 W broil element 168, in a broil configuration, upper oven 120 utilizes 2500 W broil element 166 and 500 W broil element 168 and, in a bake configuration, upper oven 120 cycles 2500 W bake element 164 and 2500 W broil element 166. Similarly, in a preheat configuration, lower oven 122 utilizes 2650 W bake element 170 and 950 W broil element 174, in a broil configuration, lower oven 122 utilizes 2650 W broil element 172 and 950 W broil element 174 and, in a bake configuration, lower oven 122 cycles 2650 W bake element 170 and 2650 W broil element 172. In an alternative embodiment, upper oven 120 and/or lower oven 122 use one or more heating elements 162 during normal operations. In a further alternative embodiment, upper oven 120 and/or lower oven 122 use different combinations of heating elements 162 during normal operations.

If three or more surface heating elements 124 are operating, electronic control 128 operates upper oven 120 and lower oven 122 in a power sharing mode. In an alternative embodiment, electronic control 128 activates the power sharing mode when fewer than three surface heating elements 124 are operating. In a further alternative embodiment, the power sharing mode is not activated if only three surface heating elements 124 are in use. In one embodiment, in a power sharing mode, upper oven 120 and lower oven 122 utilize reduced preheat and reduced broil functions. In this embodiment, during reduced preheat and reduced broil functions, electronic control 128 activates switches 176 such that only one heating element 162 is operational within upper oven 120 or lower oven 122. For example, during reduced preheat, upper oven 120 utilizes only 2500 W bake element 164 and, during reduced broil, upper oven 120 utilizes only 2500 W broil element 166. Similarly, during reduced preheat, lower oven 122 utilizes only 2650 W bake element 170 and, during reduced broil, lower oven 122 utilizes only 2650 W broil element 172. In this embodiment, a reduced bake function is not necessary because under normal baking conditions upper oven 120 cycles 2500 W bake element 164 and 2500 W broil element 166 and lower oven 122 cycles 2650 W bake element 170 and 2650 W broil element 172.

Figure 3:
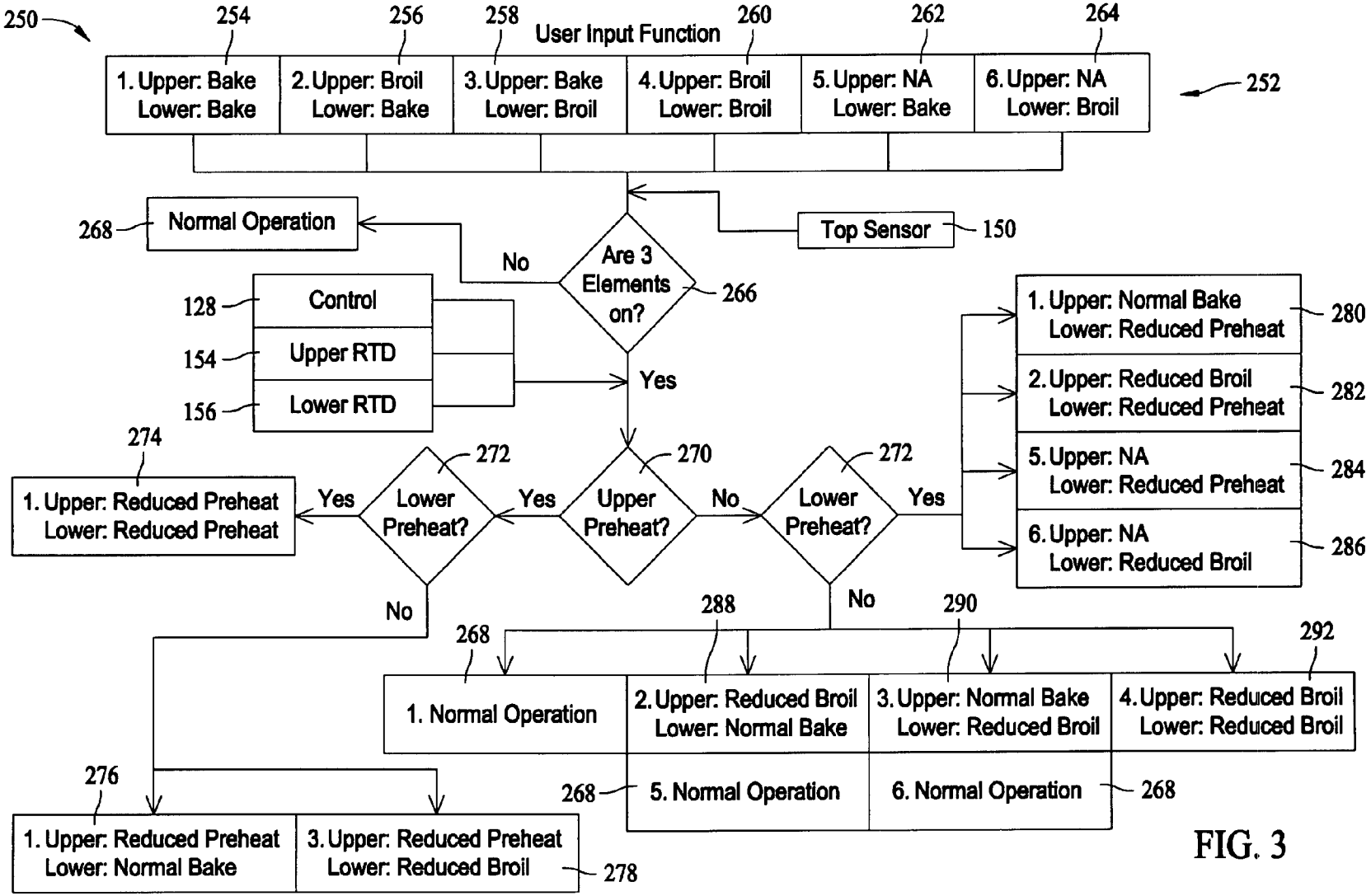
FIG. 3 is a flowchart of range operations and power sharing utilized by the range shown in FIG. 1.

FIG. 3 is a flowchart 250 of range operations and power sharing utilized by range 100 according to one embodiment. Input boxes 252 illustrate possible combinations of oven functions when power sharing could be employed. In a first dual oven operation 254, upper oven 120 utilizes the bake function and lower oven 122 also utilizes the bake function. In a second dual oven operation 256, upper oven 120 utilizes the broil function and lower oven 122 utilizes the bake function. In a third dual oven operation 258, upper oven 120 utilizes a bake function and lower oven 122 utilizes a broil function. In a fourth dual oven operation 260, upper oven 120 utilizes a broil function and lower oven 122 also utilizes a broil function. In a first single oven operation 262, in the exemplary embodiment, lower oven 122 utilizes a bake function and upper oven 120 is not in use. In an alternative embodiment, upper oven 120 utilizes a bake function and lower oven 122 is not in use. In a second single oven operation 264, in the exemplary embodiment, lower oven 122 utilizes a broil function and upper oven 120 is not in use. In an alternative embodiment, upper oven 120 utilizes a broil function and lower oven 122 is not in use.

Voltage sensors 150 indicate to control module 151 which of surface heating elements 124 are activated, and in step 266, electronic control 128 determines whether three or more surface heating elements 124 are activated. If fewer than three surface heating elements 124 are activated, upper oven 120 and lower oven 122 utilize normal operation 268. If three or more surface heating elements 124 are activated, upper oven detector 154 and lower oven detector 156 indicate the function of corresponding oven 120, 122 and electronic control 128 shares power between upper oven 120 and lower oven 122 accordingly.

In one embodiment, electronic control 128 determines whether upper oven 120 requires preheat 270 and whether lower oven 122 requires preheat 272. If both upper oven 120 and lower oven 122 require preheat, electronic control 128 shares power by operating both upper oven 120 and lower oven 122 in a reduced preheat mode 274. If only upper oven 120 requires preheat, two options are available for power sharing. During first dual oven operation 254, power is shared 276 by operating upper oven 120 in a reduced preheat mode and operating lower oven 122 in a normal bake mode. Alternatively, during third dual oven operation 258, power is shared 278 by operating upper oven 120 in a reduced preheat mode and operating lower oven 122 in a reduced broil mode.

If upper oven 120 does not require preheat, electronic control 128 next determines whether lower oven 122 requires preheat 272. If only lower oven 122 requires preheat, four options for power sharing are available. Specifically, during first dual oven operation 254, power is shared 280 by operating upper oven 120 in a normal bake mode and operating lower oven 122 in a reduced preheat mode. During second dual oven operation 256, power is shared 282 by operating upper oven 120 in a reduced broil mode and operating lower oven 122 in a reduced preheat mode. During first single oven operation 262, power is shared 284 by operating lower oven 122 in a reduced preheat mode. During second single oven operation 264, power is shared 286 by operating lower oven 122 in a reduced broil mode.

If upper oven 120 and lower oven 122 do not require preheat, first dual oven operation 254, first single oven operation 262, and second single oven operation 264 continue normal operation 268 and three options are available for power sharing during other oven operations. Specifically, during second dual oven operation 256, power is shared 288 by operating upper oven 120 in a reduced broil mode and operating lower oven 122 in a normal bake mode. During third dual oven operation 258, power is shared 290 by operating upper oven 120 in a normal bake mode and operating lower oven 122 in a reduced broil mode. Finally, during fourth dual oven operation 260, power is shared 292 by operating both upper oven 120 and lower oven 122 in a reduced broil mode.

Figure 4:
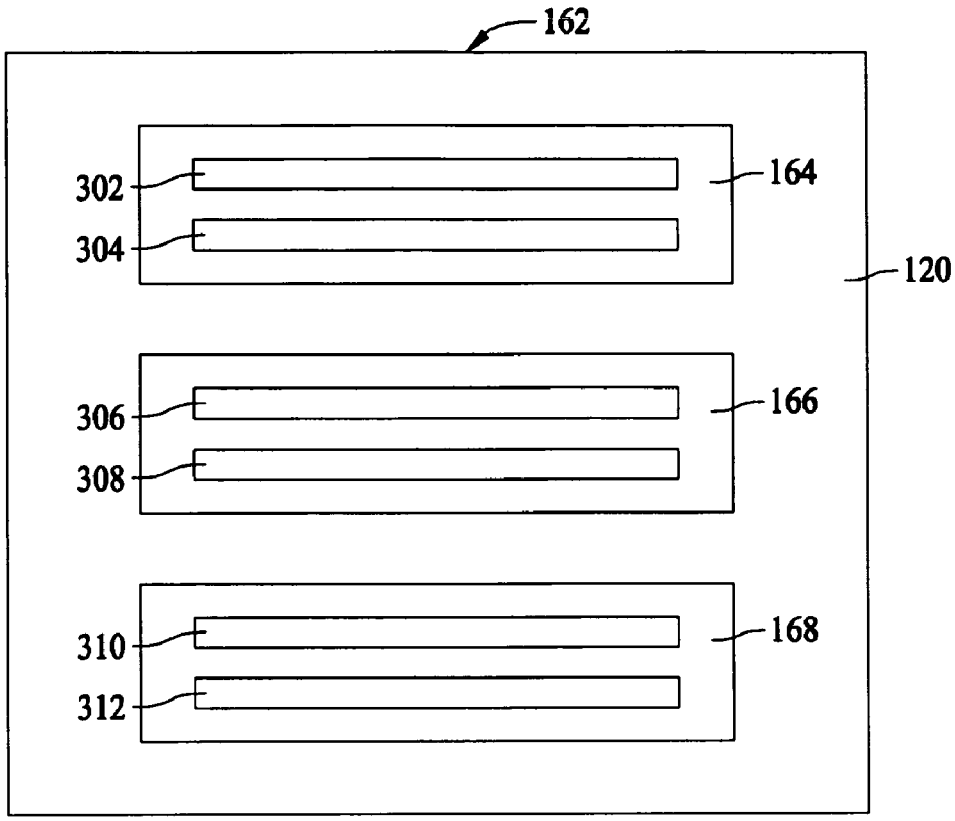
FIG. 4 is a view of an alternative power sharing electrical configuration suitable for use with the range shown in FIG. 1.
Figure 4:
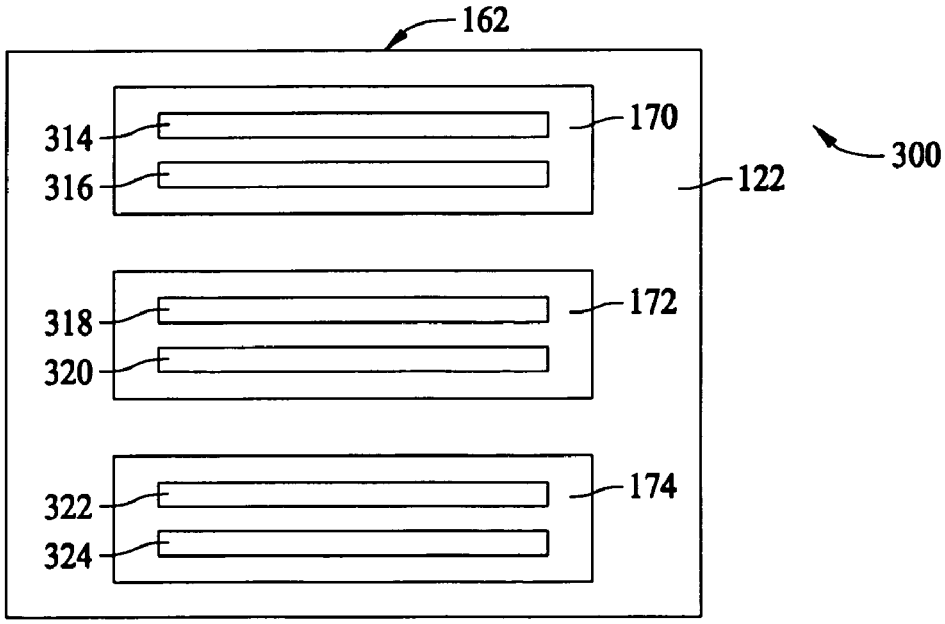

FIG. 4 is a view of an alternative power sharing electrical configuration 300 that may be used with range 100. In one embodiment, power sharing electrical configuration 300 is utilized with the power sharing configuration described hereinabove. In the exemplary embodiment, each heating element 162 of upper oven 120 and lower oven 122 includes two heating coils. In this embodiment, 2500 W heating element 164 includes a 1300 W heating coil 302 and a 1200 W heating coil 304, 2500 W broil element 166 includes a 1300 W heating coil 306 and a 1200 W heating coil 308 and 500 W broil element 168 includes a 300 W heating coil 310 and a 200 W heating coil 312. Further, 2650 W heating element 170 includes a 1450 W heating coil 314 and a 1200 W heating coil 316, 2650 W broil element 172 includes a 1450 W heating coil 318 and a 1200 W heating coil 320 and 950 W broil element 174 includes a 550 W heating coil 322 and a 400 W heating coil 324. In an alternative embodiment, each heating coil operates at a different suitable wattage. In a further alternative embodiment, each heating element 162 includes any suitable number of coils.

Figure 5:
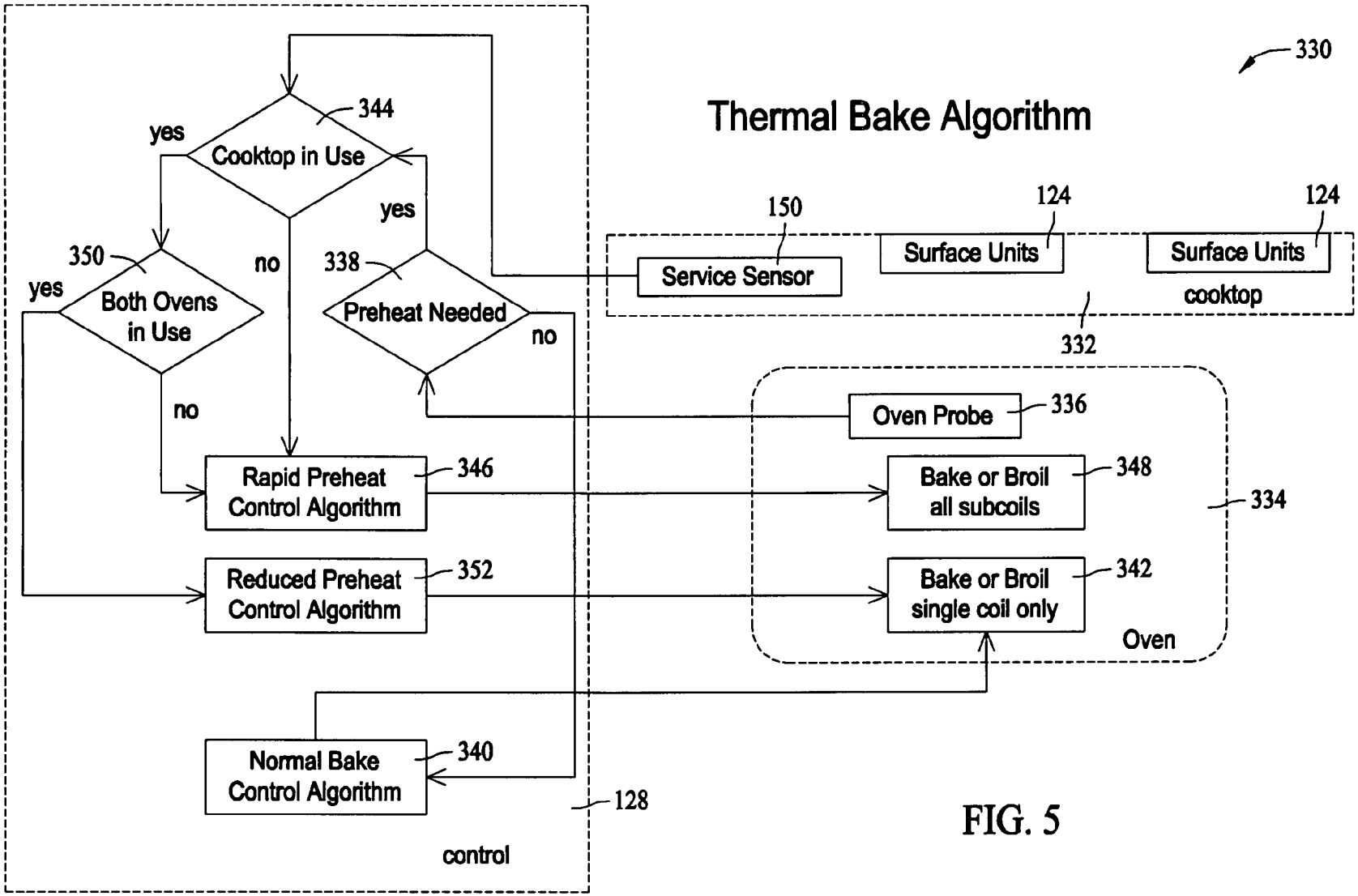
FIG. 5 is an exemplary algorithm suitable for use with the electrical configuration shown in FIG. 4.

During operation, power is shared between upper oven 120 and lower oven 122 by controlling the operation of each individual heating coil within heating elements 162. FIG. 5 is an exemplary algorithm 330 that may be used with electrical configuration 300. In one embodiment, cooktop 332 includes surface heating elements 124 and sensor 150. Oven 334 includes an oven probe 336. In this embodiment, oven 334 is one of upper oven 120 and lower oven 122 and oven probe 336 is one of corresponding detectors 154 and 156. Electronic control 128 receives input from sensor 150 and oven probe 336. Electronic control 128 determines, using input from oven probe 336, whether a preheat mode is needed 338 in oven 334. If a preheat mode is unnecessary, oven 334 operates using a normal bake control algorithm 340, such that baking or broiling is performed using only one heating coil 342. In an alternative embodiment having more than two coils, normal bake control algorithm 340 may use more than one heating coil.

If a preheat mode is necessary, electronic control 128 determines, using input from sensor 150, whether cooktop 332 is in use 344. If the cooktop is not in use, oven 334 operates using a rapid preheat control algorithm 346, such that baking and broiling utilizes all heating coils 348. If cooktop 332 is in use, electronic control 128 determines whether both upper oven 120 and lower oven 122 are in use 350. If only one oven is in use, oven 334 operates using rapid preheat control algorithm 346. If both ovens are in use, oven 334 operates using a reduced preheat control algorithm 352, such that only one bake or broil heating coil is utilized 342.

In one embodiment, a method for operating an electric cooking appliance is provided. The method includes monitoring an operational status of a plurality of surface heating elements using a sensor and sharing power between a first cooking unit and a second cooking unit based on the operational status of the plurality of surface heating elements.

The above-described apparatus and methods facilitate limiting power usage by an electric range when multiple range elements are operating. Specifically, the operation of the surface heating elements is monitored to determine whether power sharing within the range is necessary. Power sharing is achieved by limiting the number of heating elements within the ovens that are available during particular oven functions and/or limiting the number of heating coils utilized by each heating element. By implementing power sharing within the range, the range is capable of operating within a buildings limited power supply.

Exemplary embodiments of an apparatus and methods for operating an electric appliance are described above in detail. The apparatus and methods are not limited to the specific embodiments described herein, but rather, components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and method as described herein.

As used herein, an element or step recited in the singular and proceeded with the word "a" or "an" should be understood as not excluding plural said elements or steps, unless such exclusion is explicitly recited. Further, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. An electric cooking appliance comprising:

a plurality of surface heating elements;

a plurality of sensors configured to monitor an operational status of a corresponding surface heating element;

a first cooking unit;

a second cooking unit; and an electronic control to facilitate sharing power between said first cooking unit and said second cooking unit based on the operational status of said plurality of surface heating elements.

2. An electric cooking appliance in accordance with claim 1 wherein each of said first cooking unit and said second cooking unit comprises a resistance temperature detector to provide a signal to said electronic control to determine if said corresponding cooking unit requires preheat, said electronic control configured to facilitate sharing power between said first cooking unit and said second cooking unit based on whether said first cooking unit and said second cooking unit require preheat.

3. An electric cooking appliance in accordance with claim 1 wherein each of said first cooking unit and said second cooking unit comprises a bake element, a first broil element and a second broil element.

4. An electric cooking appliance in accordance with claim 3 wherein, during a normal operation of each of said first cooking unit and said second cooking unit, two of said bake element, said first broil element and said second broil element are activated by said electronic control.

5. An electric cooking appliance in accordance with claim 3 wherein said electronic control shares power between said first cooking unit and said second cooking unit by operating at least one of said first cooking unit and said second cooking unit at a reduced power, said operation at a reduced power utilizing one of said bake element and said first broil element.

6. An electric cooking appliance in accordance with claim 3 wherein each of said bake element, said first broil element and said second broil element comprises at least two heating coils, and said electronic control shares power between said first cooking unit and said second cooking unit by controlling a number of said heating coils that are operable within each of said bake element, said first broil element and said second broil element.

7. An electric cooking appliance in accordance with claim 3 wherein:

said first cooking unit bake element is operable at a power of about 2500 W, said first cooking unit first broil element is operable at a power of about 2500 W, and said first cooking unit second broil element is operable at a power of about 500 W; and said second cooking unit bake element is operable at a power of about 2650 W, said second cooking unit first broil element is operable at a power of about 2650 W, and said second cooking unit second broil element is operable at a power of about 950 W.

8. An electronic system configured for facilitating power sharing, said electronic system comprising:

a plurality of power consuming elements;

a plurality of first sensors each operatively coupled to a corresponding power consuming element of said plurality of power consuming elements, each said first sensor monitoring an operational status of said corresponding power consuming element;

a first unit comprising a first operation element, a second operation element and a third operation element;

a second unit comprising a fourth operation element, a fifth operation element and a sixth operation element; and a control unit operatively coupled to each of said first unit and said second unit, said control unit sharing power between said first unit and said second unit based on the operational status of said plurality of power consuming elements.

9. An electronic system in accordance with claim 8 further comprising a plurality of resistance temperature detectors operatively coupled to one of said first unit and said second unit, said resistance temperature detectors providing a signal to said control unit to determine a required operation of said corresponding units, said control unit sharing power between said first unit and said second unit based on the required operation of said first unit and said second unit.

10. An electronic system in accordance with claim 8 wherein a normal operation of said first unit utilizes two of said first operation element, said second operation element and said third operation element, and normal operation of said second unit utilizes two of said fourth operation element, said fifth operation element and said sixth operation element.

11. An electronic system in accordance with claim 8 wherein said control unit shares power between said first unit and said second unit by operating at least one of said first unit and said second unit at a reduced power, said operation of said first unit at a reduced power utilizes one of said first operation element, said second operation element and said third operation element, and said operation of said second unit at a reduced power utilizes one of said fourth operation element, said fifth operation element and said sixth operation element.

12. An electronic system in accordance with claim 8 wherein each of said first operation element, said second operation element, said third operation element, said fourth operation element, said fifth operation element, and said sixth operation element each comprises at least two electrical coils, said control unit shares power between said first unit and said second unit by controlling a number of said electrical coils that are operable within each of said first operation element, said second operation element, said third operation element, said fourth operation element, said fifth operation element, and said sixth operation element.

13. An electronic system in accordance with claim 8 wherein:

said first operation element is operable at a power of about 2500 W, said second operation element is operable at a power of about 2500 W, and said third operation element is operable at a power of about 500 W; and said fourth operation element is operable at a power of about 2650 W, said fifth operation element is operable at a power of about 2650 W, and said sixth operation element is operable at a power of about 950 W.

14. A method of operating an electric cooking appliance, said method comprising:

monitoring an operational status of a plurality of surface heating elements using a sensor; and sharing power between a first cooking unit and a second cooking unit based on the operational status of the plurality of surface heating elements.

15. A method in accordance with claim 14 further comprising:

monitoring whether each of the first cooking unit and the second cooking unit require preheat; and sharing power between the first cooking unit and the second cooking unit based on whether the first cooking unit and the second cooking unit require preheat.

16. A method in accordance with claim 14 wherein each of the first cooking unit and the second cooking unit comprises a bake element, a first broil element and a second broil element, said method further comprising operating each of the first cooking unit and the second cooking unit by controlling at least one of the bake element, the first broil element, and the second broil element of at least one of the first cooking unit and the second cooking unit.

17. A method in accordance with claim 16 further comprising operating each of the first cooking unit and the second cooking unit by utilizing two of the bake element, the first broil element and the second broil element.

18. A method in accordance with claim 16 wherein sharing power between the first cooking unit and the second cooking unit further comprises operating at least one of the first cooking unit and the second cooking unit at a reduced power.

19. A method in accordance with claim 18 wherein operating at a reduced power comprises utilizing one of the bake element and the first broil element.

20. A method in accordance with claim 16 wherein each of said bake element, said first broil element and said second broil element comprises at least two heating coils, said method further comprising sharing power between said first cooking unit and said second cooking unit by controlling a number of said heating coils that are operable within each of said bake element, said first broil element and said second broil element.

* * * * *